US005256940A

United States Patent [19]

Wada et al.

[11] Patent Number: 5,256,940

[45] Date of Patent: Oct. 26, 1993

[54] HIGH INTENSITY DISCHARGE LAMP DEVICE

[75] Inventors: Shigeaki Wada; Atsunori Okada; Shingo Higashisaka, all of Kadoma, Japan

[73] Assignee: Matsushita Electric Works, Ltd., Osaka, Japan

[21] Appl. No.: 857,072

[22] Filed: Feb. 25, 1992

Related U.S. Application Data

[63] Continuation of Ser. No. 603,297, Oct. 25, 1990, abandoned.

[30] Foreign Application Priority Data

Nov. 8, 1989 [JP] Japan ..... 1-290373

[51] Int. Cl.[5] ..... H05B 41/16; H01J 61/20

[52] U.S. Cl. ..... 315/248; 313/640

[58] Field of Search ..... 315/248, 39; 313/638, 313/642, 639, 641, 640

[56] References Cited

U.S. PATENT DOCUMENTS

| | | | |
|---|---|---|---|
| 3,761,758 | 9/1973 | Bamberg | 313/640 |
| 4,135,110 | 1/1979 | Chalmers | 313/642 |
| 4,171,498 | 10/1979 | Fromm | 313/641 |
| 4,243,906 | 1/1981 | Wilson | 313/640 |
| 4,492,898 | 1/1985 | Lapatovich | 315/248 |
| 4,591,759 | 5/1986 | Chalek et al. | 313/638 |
| 4,705,987 | 11/1987 | Johnson | 313/634 |
| 4,810,938 | 3/1989 | Johnson et al. . | |

FOREIGN PATENT DOCUMENTS

| | | |
|---|---|---|
| 0183247 | 6/1985 | European Pat. Off. . |
| 1253948 | 11/1971 | United Kingdom . |
| 1316803 | 5/1973 | United Kingdom . |
| 1498258 | 1/1978 | United Kingdom . |
| 1603846 | 12/1981 | United Kingdom . |
| 2210498 | 6/1989 | United Kingdom . |
| 2219431 | 12/1989 | United Kingdom . |

*Primary Examiner*—Steven Mottola

*Attorney, Agent, or Firm*—Burns, Doane, Swecker & Mathis

[57] ABSTRACT

A high intensity discharge lamp device is formed from materials which form complex halides enclosed in an arc tube in addition to rare gas and metal halides, to realize the high reproducibility of luminous color called for in visual machines and devices and so on.

8 Claims, 7 Drawing Sheets

HIGH INTENSITY DISCHARGE LAMP DEVICE

This application is a continuation of application Ser. No. 07/603,297, filed Oct. 25, 1990, now abandoned.

BACKGROUND OF THE INVENTION

This invention relates generally to high intensity discharge lamp devices and, more particularly, to a high intensity discharge lamp which has omitted mercury from filled material within an arc tube.

The high intensity discharge lamp has been widely and increasingly employed, in addition to the field of illumination, in such further fields of nonillumination including visual, business and office machines and devices, visual projecting apparatus and so on.

DESCRIPTION OF RELATED ART

Generally, the high intensity discharge lamp device is formed by providing an arc tube within a light transmissive envelope while enclosing in the arc tube mercury, rare gas and metal halides, and providing to both ends of the arc tube a pair of electrodes which are connected preferably through a metal foil to lead wires to which an external circuit is connectable. With such a high intensity discharge lamp device, it is possible to provide a white light source showing a high efficiency and a high color rendering. Further, while the high intensity lamp has been increasingly utilized in recent types of the visual, business and office machines and devices, visual projecting apparatus and so on, in these cases it has been a common requisite for such high intensity discharge lamp devices to provide excellent reproducibility of luminous color.

It has been a demand, on the other hand, that the discharge lamp can light with the same lamp voltage as that of existing lamps for enabling existing light circuits to be utilizable and, for this purpose, there has been a tendency, in the case where the arc tube is small, to increase the amount of filled mercury within the arc tube. When the filled mercury amount increases, however, the luminous color reproducibility deteriorates.

In view of the above, high intensity discharge lamps having improved color rendering property by omitting mercury have been provided. For example, in U.S. Pat. No. 4,810,938 by P. D. Johnson et al, a high intensity discharge lamp employs metal halides and Xe gas as filling materials in the light transmissive arc discharge tube but omits mercury therefrom. According to this U.S. patent, it may be possible to improve the luminous color reproducibility to some extent because of the absence of mercury, but mercury free lamps still involve the drawback of attaining the sufficient color reproducibility demanded in the field of nonillumination of visual machines and devices and so on, since the patent omits mercury but has no intention of remarkably improving the color reproduction triangle in the chromaticity coordinates.

SUMMARY OF THE INVENTION

A primary object of the present invention is, therefore, to provide a high intensity discharge lamp device which eliminates the foregoing drawback, and which satisfies the luminous color reproducibility demanded in such nonillumination fields as visual and business or office machines and devices, visual projecting apparatus and so on by sufficiently enlarging the color reproduction triangle presented in the chromaticity coordinates.

According to the present invention, this object can be attained by means of a high intensity discharge lamp device formed with rare gas and metal halides enclosed in an arc tube in which an arc discharge is enclosed, wherein materials which form complex halides are further enclosed in the arc tube.

Other objects and advantages of the present invention will be made clear in the following detailed description of the invention.

BRIEF DESCRIPTION OF THE DRAWINGS

For a full understanding of the invention, the following detailed description should be read in conjunction with the drawings, wherein.

While the present invention shall now be explained with reference to respective examples described, it should be appreciated that the intention is not to limit the invention only to such examples but rather to cover all alterations, modifications and equivalent arrangements possible within the scope of the appended claims.

DETAILED DESCRIPTION OF THE PREFERRED EMBODIMENTS

Example 1

Figure 1:
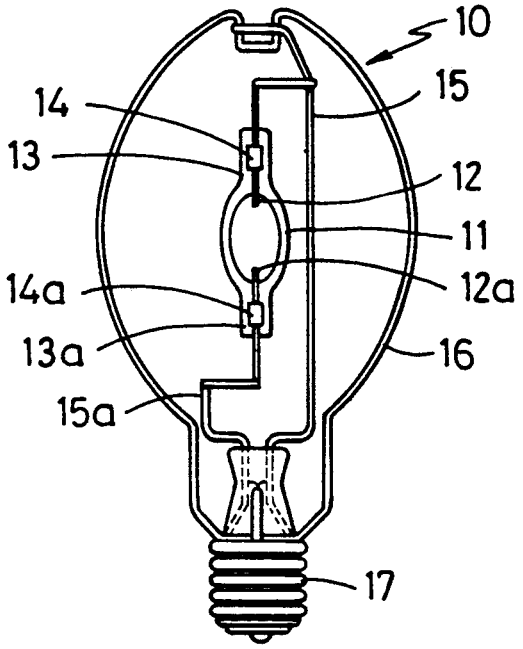
FIG. 1 is a vertically sectioned view of a high intensity discharge lamp device according to the present invention.

Referring to FIG. 1, it there is shown a high intensity discharge lamp device according to the present invention, in which the lamp device 10 comprises an arc tube 11 formed by a quartz glass and provided at both ends with a pair of electrodes 12 and 12*a* opposing each other. These electrodes 12 and 12*a* are connected respectively to metal foils 14 and 14*a* such as, preferably, molybdenum foils, which are sealed in enclosures 13 and 13*a*, while the metal foils 14 and 14*a* are electrically connected to support conductor wires 15 and 15*a* also functioning as a supporting member for the arc tube 11 so that the tube 11 will be mechanically fixed by the wires 15 and 15*a*. The support conductor wires 15 and 15*a* are arranged for connection to an external circuit (not shown) such as a lamp lighting circuit through a capsule 17 fitted to an end of the envelope 16.

Figure 2:
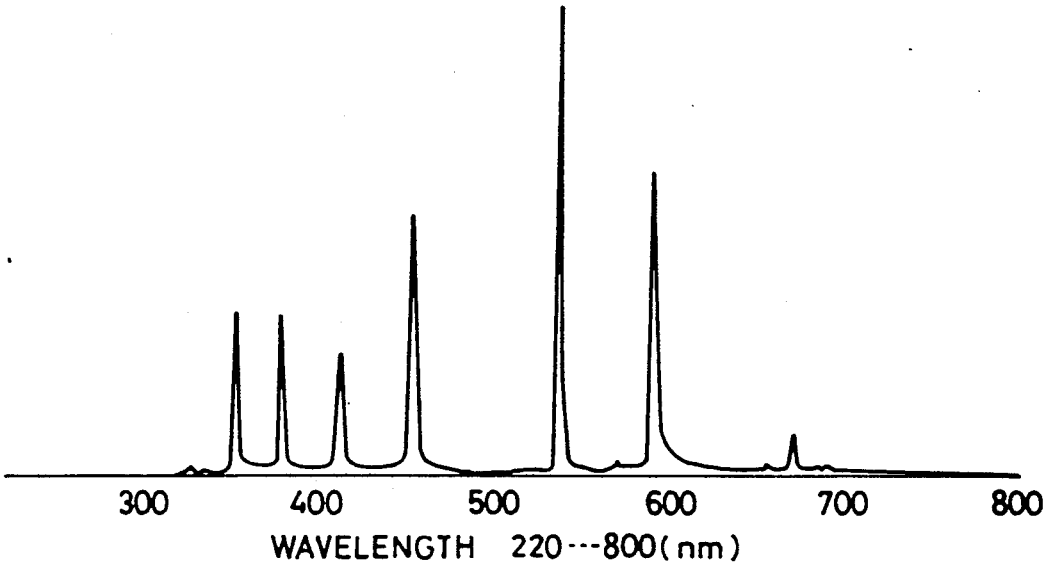
FIG. 2 shows an emission spectrum of the lamp device of FIG. 1 according to the present invention.
Figure 3:
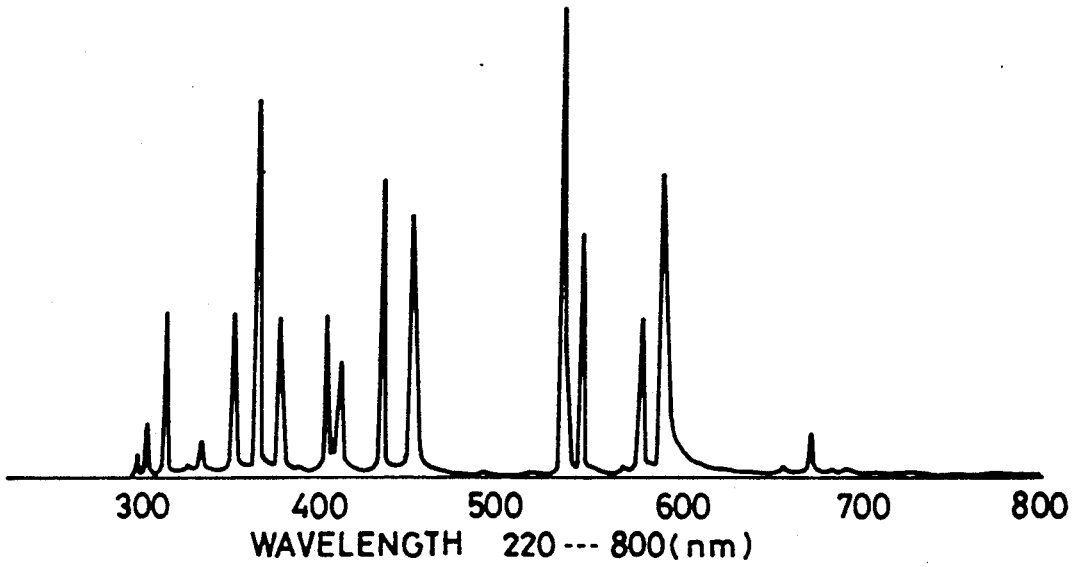
FIG. 3 shows an emission spectrum of a device according to a comparative example in which mercury is added to the device of FIG. 1.
Figure 4:
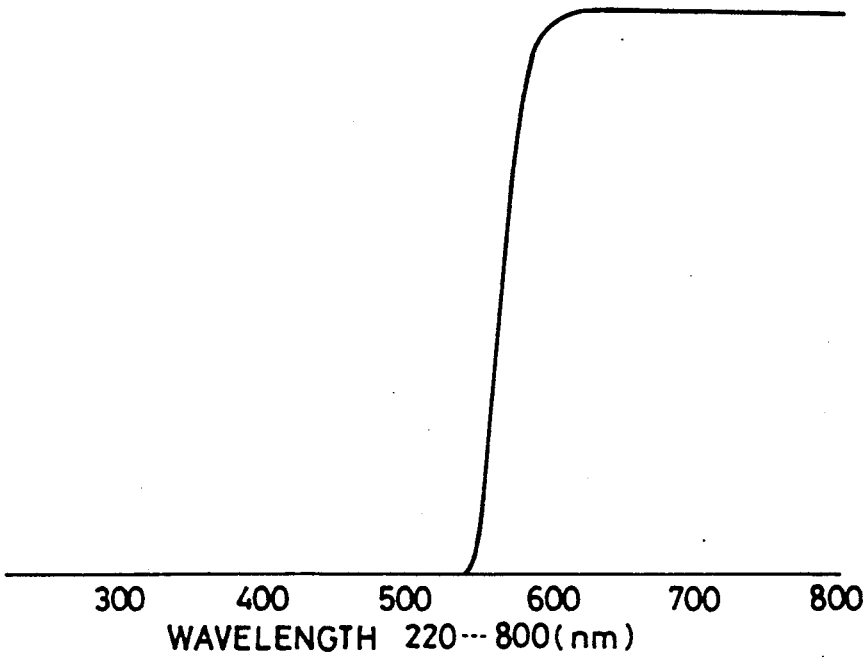
FIG. 4 is a diagram showing a distribution of spectral transmittance with a red color filter.
Figure 5:
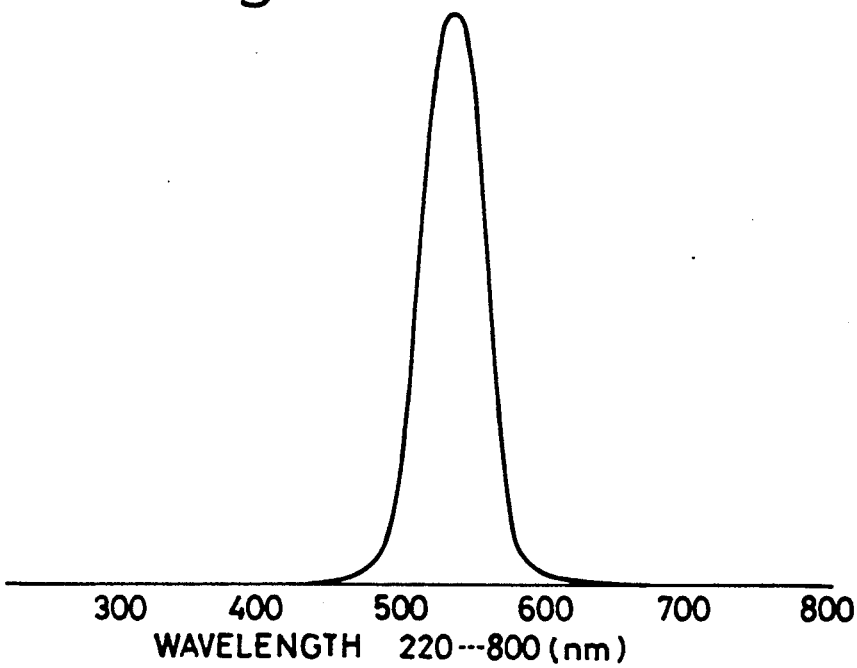
FIG. 5 is a diagram showing a distribution of spectral transmittance with a green color filter.
Figure 6:
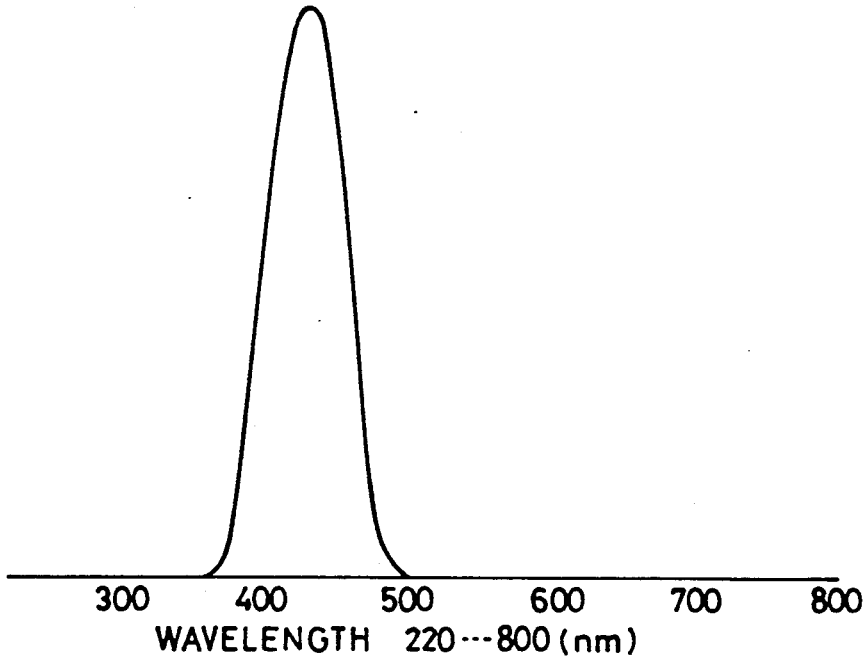
FIG. 6 is a diagram showing a distribution of spectral transmittance with a blue color filter.
Figure 7:
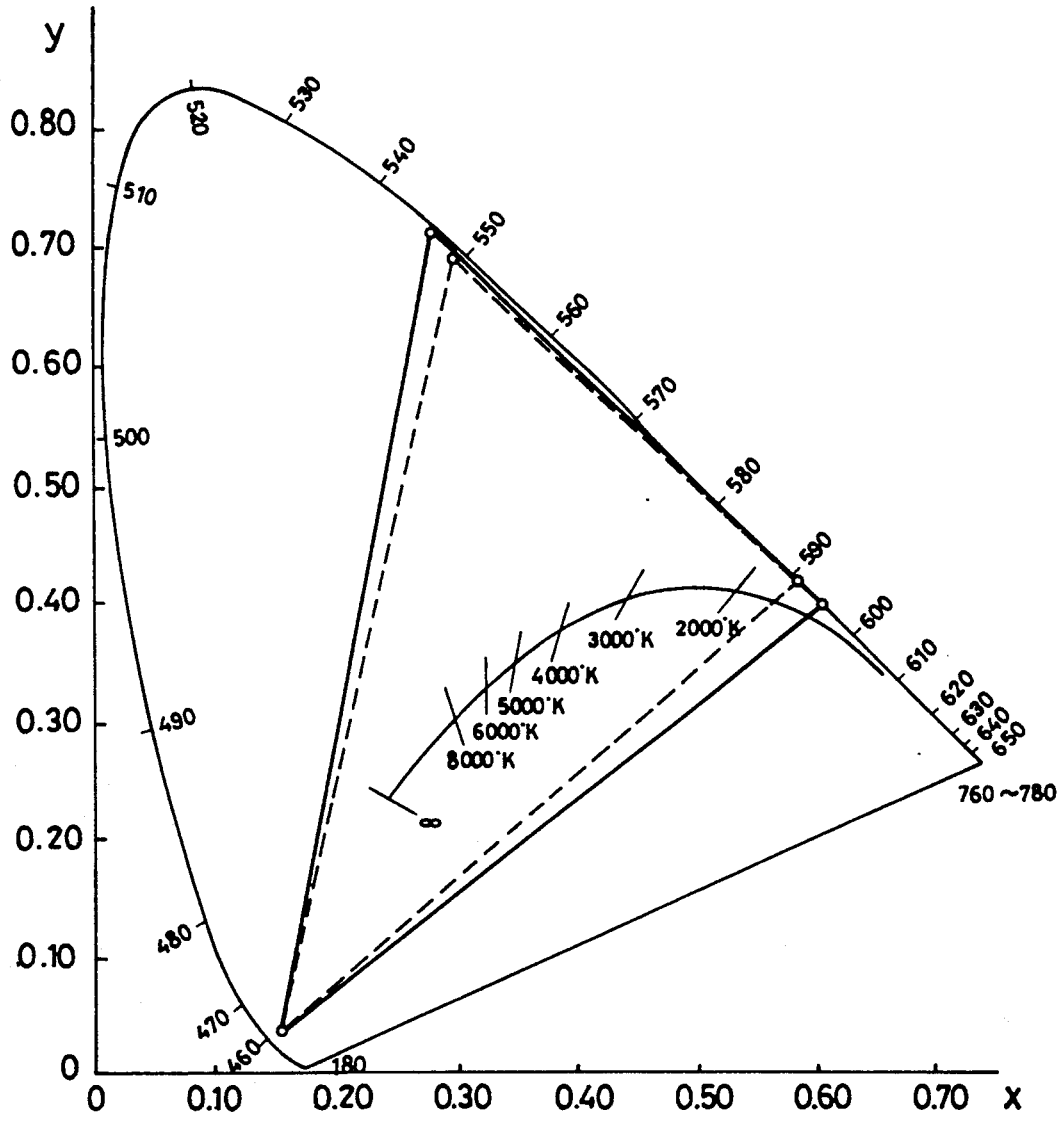
FIG. 7 is a diagram showing a color reproduction range of the lamp device of FIG. 1 in comparison with that of a comparative example with mercury employed.

Within the arc tube 11, 100 Torr of Xe gas and, as metal halides, NaI(8 mg)-TlI(1.5 mg)-InI(0.5 mg) are sealed. An emission spectrum of this Example is shown in FIG. 2, and, as will become clear when compared with FIG. 3 showing an emission spectrum of a lamp device in which several ten Torr of Ar in place of Xe and 40 mg of mercury are added, it is possible to restrain emission spectra other than the emission spectrum of Na (main wavelength 589 nm; orange), Tl (main wavelength 535 nm; green) and In (main wavelength 451 nm; blue). Here, color reproduction triangles of the lamp device according to the instant Example 1 having such emission spectrum as shown in FIG. 2 and the comparative lamp device according to the comparative example having the emission spectrum of FIG. 3 are given as presented on the chromaticity coordinates of FIG. 7, with vacuum-deposited film filters of red, green and blue of such spectral transmittances as shown in FIGS. 4–6 employed. In FIG. 7, it should be appreciated that a color reproduction triangle of dotted lines denotes the comparative example, whereas the color reproduction triangle represented by solid lines denotes the instant Example 1 of the present invention. FIG. 7 demonstrates that the color reproduction triangle can be remarkably enlarged according to the present invention, that is, the luminous color reproducibility can be sufficiently improved by the present invention.

It has been also revealed that, while the comparative example requires a power of 250W for obtaining a light output of 18,000 lm at white point, Example 1 requires only 230W for obtaining the same light output, so that about 10% power saving can be attained.

It has been possible to attain the same result in the case where 200 Torr of Kr was enclosed instead of Xe.

Example

Figure 8:
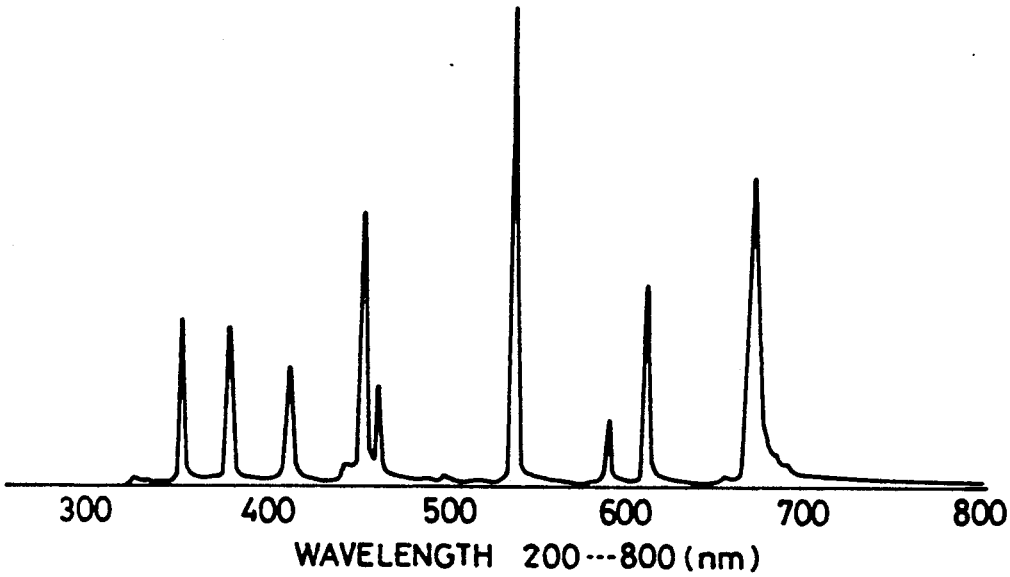
FIG. 8 is an emission spectrum of the high intensity discharge lamp device according to the present invention.
Figure 9:
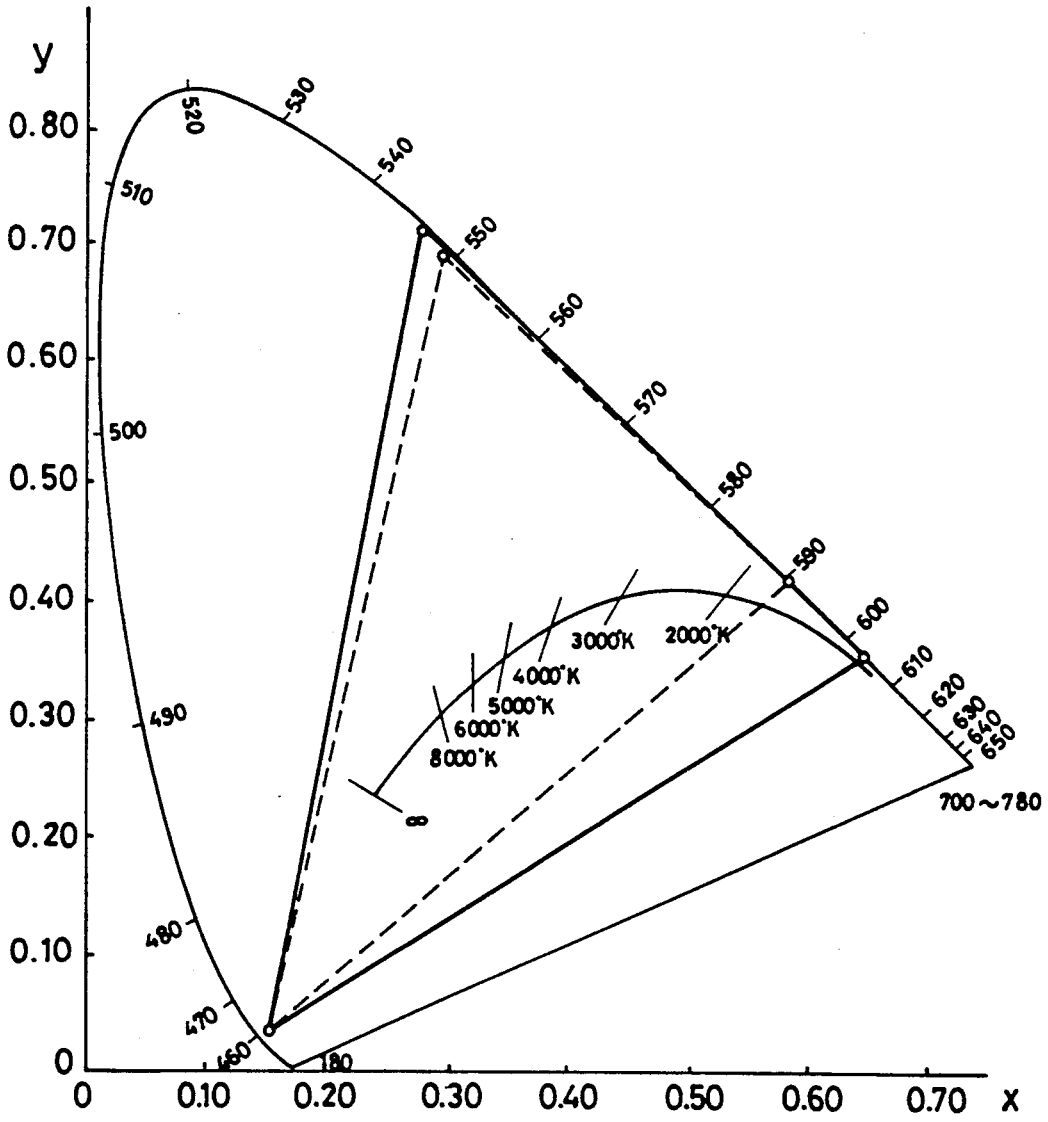
FIG. 9 is a diagram showing a color reproduction range of the lamp device of FIG. 8 in comparison with that of the comparative example with mercury employed.

100 Torr of Xe gas, LiI (9 mg), TlI (1.5 mg) and InI (0.5 mg) were enclosed in the same arc tube 11 as in Example 1. The emission spectrum in the case of this Example 2 is as shown in FIG. 8, and the color reproduction triangles of the respective lamp devices of this Example 2 having such emission spectrum as in FIG. 8 and of the comparative example having the emission spectrum of FIG. 3 are given in FIG. 9, with the vacuum deposited filters of red, green and blue of such spectral transmittances as in FIGS. 4–6 employed, in the same manner as in FIG. 7. As would be clear from FIG. 9, it has been found that the color reproducibility can be further improved in the present Example 2 than in the case of Example 1.

Examples 3 and 4

The arc tube 11 employed in Examples 1 and 2 was formed with light transmissive alumina ceramics.

In Examples 1 and 2 a red emission output with Na of 589 nm and Li of 671 nm has shown to be deteriorated after several hundred hours from the start of the lighting in response to a diffusion of alkali metal cation of small radius in quartz glass wall of the arc tube during the lighting. However the use of the alumina ceramics of more dense structure than the quartz glass in Examples 3 and 4 has successfully restrained such diffusion of Na and Li into the arc tube wall. Measurements showed no deterioration in the red emission output even after a long term lighting for 6,000 hours.

Example 5

Figure 10:
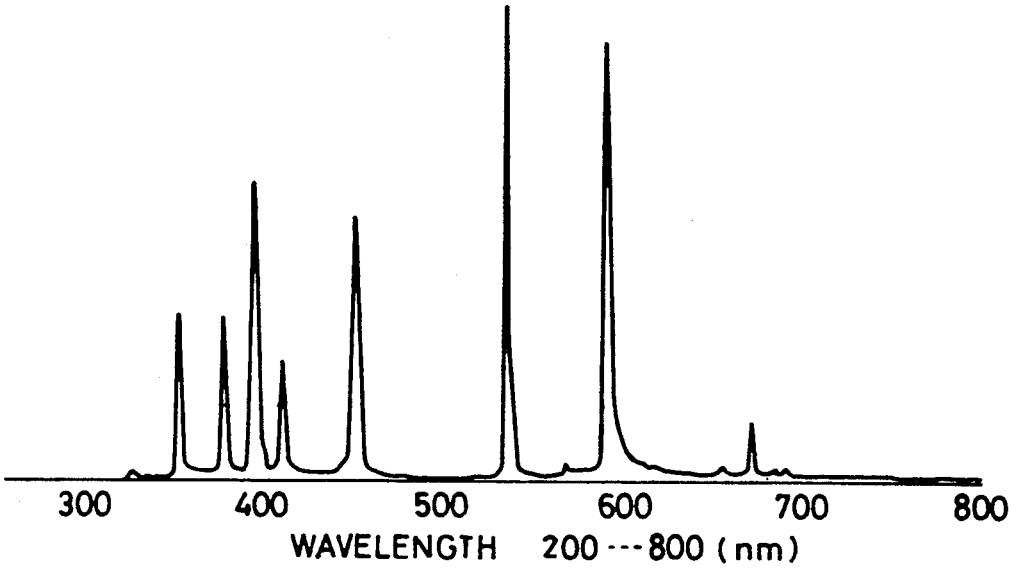
FIG. 10 is an emission spectrum of the high intensity discharge lamp device according to the present invention.

Within the same arc tube 11 as in Example 1, 150 Torr of Xe gas was enclosed together with NaI (8 mg), TlI (1.8 mg), InI (0.6 mg) and $AlCl_3$ (2 mg). An emission spectrum of this Example 5 is as shown in FIG. 10, from which it has been found that, since NaI and $AlCl_3$ constitute a complex halide, the emission output of Na of 589 nm is increased to be 1.5 times as large as that in Example 1 with respect to the same input power. Consequently, it has been found that, in order to attain the same white chromaticity coordinates as in Example 1, only a smaller amount of the input power is required so as to be 200W in contrast to 230W required in Example 1 since tube wall temperature of the arc tube 11 is restrained to be low, and a remarkable power saving can be attained.

The same result could be obtained even when NaCl and NaBr or LiI, LiCl and LiBr were enclosed in the arc tube instead of NaI. It has been also possible to attain the same result in the case where $AlI_3$ and $AlBr_3$ or $SnCl_2$, $SnI_2$ and $SnBr_2$ were enclosed in place of $AlCl_3$.

Example 6

Figure 11:
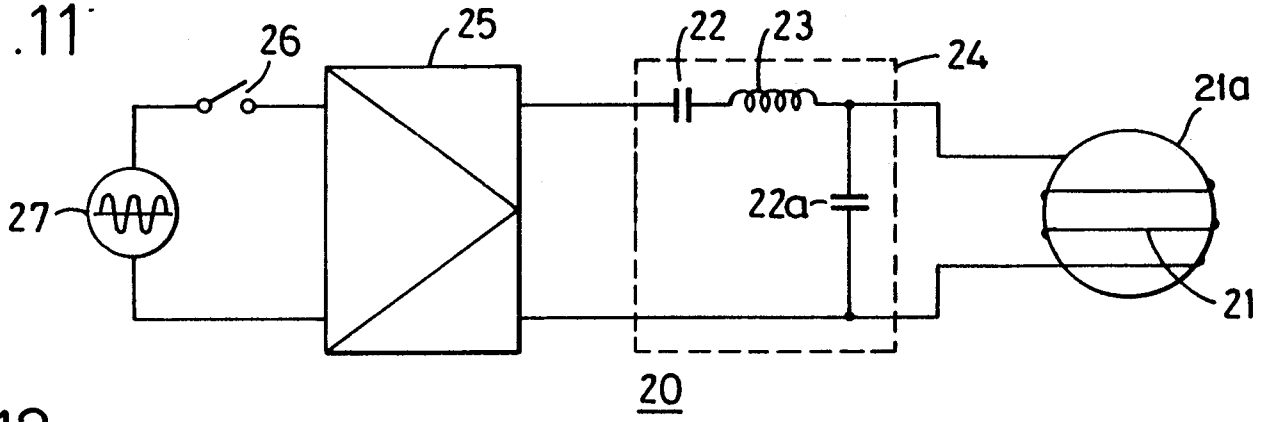
FIG. 11 is a schematic block circuit diagram of a high frequency lamp lighting circuit employed in the present invention.

An electrodeless arc tube with the same filling materials as in Example 5 was lighted by means of such lighting circuit 20 of high frequency voltage application system as shown in FIG. 11, in which the lighting circuit 20 has comprised a power supplying coil 21 wound around the arc tube 21*a* and an impedance matching circuit 24 comprising capacitors 22 and 22*a* and a coil 23 was connected to the power supplying coil 21. And a high frequency oscillator 27 was connected to the impedance matching circuit 24 through a power amplifier 25 and a switch 26. For the purpose of comparison with the instant Example, the lighting with a known lighting circuit of the arc tube 11 having the electrodes as in Example 5 of the arrangement of FIG. 1 was carried out, and the both arc tubes thus lighted were subjected to a measurement of the relationship between the lighting hour and the luminous flux.

Comparative Example

Several ten Torr of Ar as well as Hg (40 mg), NaI (8 mg), TlI (1.5 mg) and InI (0.5 mg) were enclosed in the same electrodeless arc tube 21*a* as in Example 6, and this arc tube was lighted by means of such lighting circuit 20 of high frequency voltage application system as shown in FIG. 11. The relationship between the lighting hour and the luminous flux was measured with respect to this arc tube.

Comparative Example 2

An arc tube having electrodes and the same filling materials therein as those in the foregoing Comparative Example 1 was lighted by means of the same lighting circuit as in the foregoing Example 5, and was subjected to the measurement of the relationship between the lighting hour and the luminous flux.

Comparative Example 3

Several ten Torr of Ar as well as Hg (40 mg), NaI (14mg) and $ScI_3$ (4 mg) were enclosed in the same arc tube having the electrodes as in FIG. 1, and this arc tube was subjected to the lighting by means of the known lighting circuit and to the measurement of the relationship between the lighting hours and the luminous flux.

Comparative Example 4

An electrodeless arc tube with the same filling materials as in Comparative Example 3 was subjected to the lighting by means of the lighting circuit of FIG. 11 employed in the foregoing Example 6 and to the measurement of the relationship between the lighting hours and the luminous flux.

The rate of deterioration in the luminous flux with respect to the lighting hours as measured for the foregoing Examples 5 and 6 as well as Comparative Examples 1 through 4 has been as shown in a following Table:

TABLE

| Device | Lighting Hour (h) | | | | |
|---|---|---|---|---|---|
| | 0 | 100 | 1,000 | 3,000 | 6,000 |
| Example 5 | 115 | 100 | 80 | 65 | 50 |
| Example 6 | 105 | 100 | 95 | 90 | 85 |
| Comp. Example 1 | 103 | 100 | 97 | 92 | 87 |
| Comp. Example 2 | 105 | 100 | 95 | 85 | 75 |
| Comp. Example 3 | 110 | 100 | 87 | 70 | 60 |
| Comp. Example 4 | 105 | 100 | 95 | 90 | 85 |

It should be clear from the above Table that an extremely excellent discharge lamp device can be realized when such luminous materials which constitute a complex halide as in Example 6 are enclosed in the electrodeless arc tube and this arc tube is lighted by such lighting circuit as in FIG. 11.

It has been found that, generally, the deterioration in the luminous flux occurs less in the lamp device of the electrodeless tube than in the case of the tube having the electrodes. This is due to that, in the arc tube having the electrodes, a reaction takes place between the metal halide and quartz which forming the arc tube to produce SiI, a further reaction of thus produced SiI with tungsten W which forming the electrodes takes place to produce an alloy of Si and W of a low melting point, and this alloy adheres to the tube wall so as to blacken the wall and to lower the light transmissivity. When in particular the luminous materials enclosed in the arc tube constitute the complex halide for improving the luminous efficiency, an intense reaction takes place between chlorine and the electrodes to cause a remarkable blackening to occur, and the electrodeless structure of the arc tube will be most desirable.

On the other hand, there arises a remarkable difference in circuit simplification of the high frequency voltage application type lighting circuit, between the arc tube having the filling materials according to the present invention and arc tubes having filling materials which include mercury, as in the Comparative Examples. Here, the lighting circuit 30 of FIG. 12 shall be explained. This lighting circuit 30 comprises an impedance matching circuit 34 connected to a power supplying coil 31 wound around the arc tube 31*a* and having variable capacitors 32 and 32*a* and a variable inductance coil 33, a circuit 38 for detecting input/output power difference, a power amplifier 35, a switch 36 and a high frequency oscillator 37. A servomotor controlling circuit 39 is connected to the input/output power difference detecting circuit 38, so that servomotors 40, 40*a* and 40*b* for regulating the electrostatic capacity and inductance of the variable capacitors 32 and 32*a* an variable inductance coil 33 will be controlled by the circuit 39. Now, as the switch 36 is put in ON state, an electrostatic field is applied across the power supplying coil 31, breakdown is caused by this field to occur in the arc tube, and the lighting is started. As an electric field is generated along extending direction of the coil 31 in proportion to time variation ratio of a magnetic field generated by the current fed to the coil 31, therefore as the conductivity within the arc tube increase, the thus generated electric field causes a current to flow in the arc tube, and an electric power is thereby supplied to the tube. Since the filling materials in the arc tube include mercury in the case of the Comparative Example, mercury discharge is formed and a weak emission is revealed. Thereafter, with the power consumed within the tube, the temperature of the tube wall rises, and the enclosed mercury or metal halide is gradually evaporated, and such metal emits light.

At the same time, mercury vapor pressure within the arc tube is raised to increase the impedance, and there arises gradually a deviation in the impedance matching between the source side and the arc tube side, so the power supply to the arc tube becomes difficult and the arc sometimes vanished. In order to prevent these phenomena, the input/output power difference is constantly monitored by the input/output power difference detecting circuit 38 so that, when the detected input/output power difference approaches a level at which the turning-off takes place in the arc tube, the servomotor control circuit 39 drives the servomotors 40, 40*a* and 40*b* to regulate the electrostatic capacity and inductance of the variable capacitors 32 and 32*a* and variable inductance coil 33, and the input/output power difference can be made to be the minimum. However, this circuit apparatus is extremely complicated and high in the cost.

Figure 12:
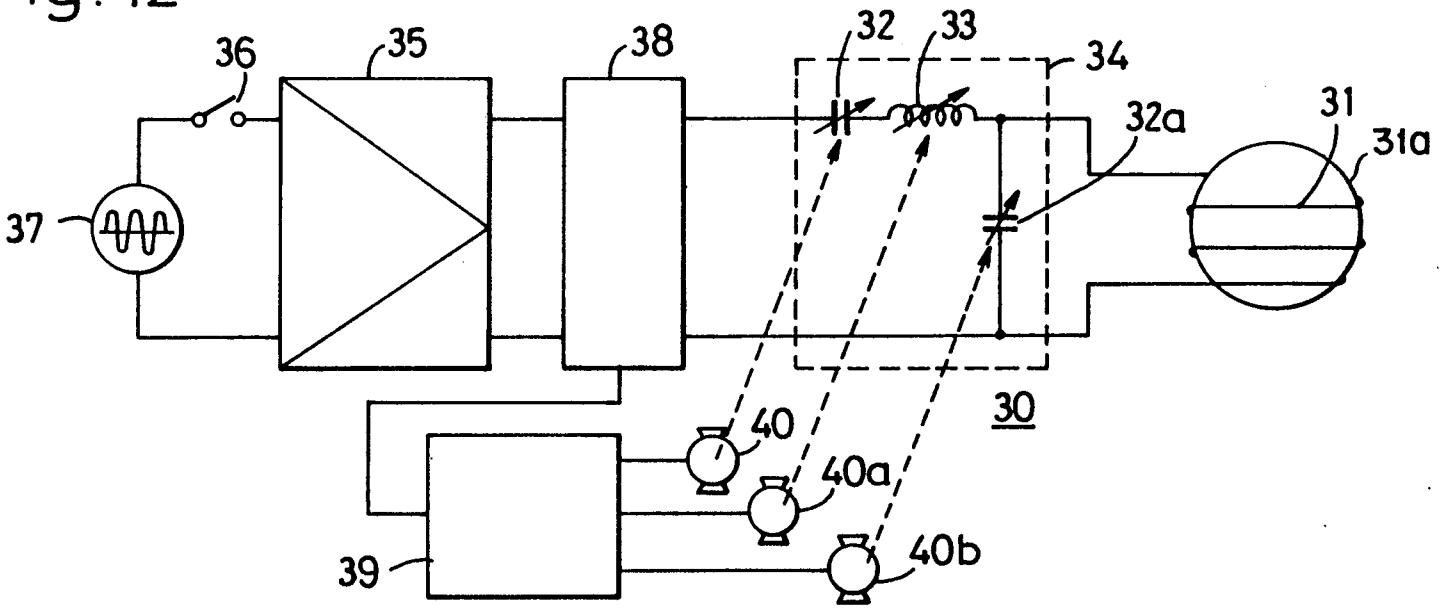
FIG. 12 is a schematic block circuit diagram of a high frequency lamp lighting circuit employed in a comparative example.

Also in the lighting circuit of FIG. 11 for the arc tube according to the present invention, closing the switch 26 causes an electric field to be generated in proportion to the time variation ratio of the magnetic field generated by a current flowing through the coil 21, and a power is supplied to the arc tube with the current made to flow in the tube by the electric field, in the same manner as in the lighting circuit 30 of FIG. 12. In the arc tube according to the present invention, however, the rise in the tube wall temperature causes the vapor pressure of the filling materials in the tube to rise only up to several hundred Torr and never to such several thousand Torr as in the case where mercury is included. In this case, too, substantially the same amount of the metal halide required for the emission as that in the presence of mercury is assured. Even when the tube wall temperature rises, the impedance in the arc tube does not vary, and no turning-off due to the impedance mismatching with the power source side takes place. It will be appreciated here that the lighting circuit for the arc tube according to the present invention no more requires the input/output power difference detecting circuit, servomotors and their controlling circuit, and that the lighting circuit can be remarkably simplified and reduced in the costs, while realizing substantially the same level of function and effect as in the foregoing comparative examples.

We claim:

1. A high intensity discharge lamp device comprising an arc tube enclosing therein an arc discharge, wherein a rare gas, a metal halide selected from the group consisting of Li halide, Tl halide, In halide, Al halide, Sn halide and mixtures thereof, with the proviso that Li halide is always present, and a substance which forms a complex halide with at least said Li halide are enclosed in said arc tube.

2. A high intensity discharge lamp device comprising an electrodeless arc tube for enclosing therein an arc discharge, said arc tube enclosing therein a rare gas, a metal halide selected from the group consisting of Li halide, Tl halide, In halide, Al halide, Sn halide and mixtures thereof, with the proviso that Al halide is always present, and a substance which forms a complex halide with said metal halide.

3. The device according to claim 1 wherein said arc tube is formed by a ceramics.

4. The device according to claim 1 wherein said arc tube has no electrode.

5. The device according to claim 3 wherein said arc tube has no electrode.

6. The device according to claim 2, wherein said Al halide is $AlCl_3$.

7. The device according to claim 2, wherein said arc tube is provided for high frequency lighting.

8. The device according to claim 4, wherein said arc tube is provided for high frequency lighting.

* * * * *